US012453430B2

(12) United States Patent
Yang

(10) Patent No.: US 12,453,430 B2
(45) Date of Patent: Oct. 28, 2025

(54) MULTIFUNCTIONAL CRIB

(71) Applicant: TJ(fujian) Industrial Co., Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 386 days.

(21) Appl. No.: 18/090,554

(22) Filed: Dec. 29, 2022

(65) Prior Publication Data

US 2023/0200559 A1 Jun. 29, 2023

(30) Foreign Application Priority Data

Dec. 29, 2021 (CN) ..... 202123356255.6

(51) Int. Cl.
*A47D 9/02* (2006.01)
*A47D 9/00* (2006.01)

(52) U.S. Cl.
CPC ..... *A47D 9/02* (2013.01); *A47D 9/008* (2022.08)

(58) Field of Classification Search
CPC . A47D 9/00; A47D 9/02; A47D 9/005; A47D 9/008; A47D 9/012; A47D 9/016; A47D 9/04; A47D 9/053; A47D 11/00; A47D 11/005; A47D 11/007; A47D 13/00; A47D 13/02
See application file for complete search history.

(56) References Cited

U.S. PATENT DOCUMENTS 744,993 A * 11/1903 Barta ..... A47D 11/005 5/174
D1,011,069 S * 1/2024 Ou ..... D6/390
D1,011,070 S * 1/2024 Yang ..... D6/390
2008/0196164 A1* 8/2008 Calilung ..... A47D 9/057 5/101
2015/0173523 A1* 6/2015 Horst ..... A47D 9/016 5/655
2015/0342367 A1* 12/2015 Corso ..... A47D 13/105 5/101
2017/0065097 A1* 3/2017 Chen ..... A47D 9/005
(Continued)

FOREIGN PATENT DOCUMENTS

CN 211092967 U 7/2020
CN 113142899 A * 7/2021 ..... A47D 9/00

*Primary Examiner* — George Sun
(74) *Attorney, Agent, or Firm* — Bayramoglu Law Offices LLC

(57) ABSTRACT

A multifunctional crib includes a left support mechanism and a right support mechanism. Each support mechanism includes a support base, a support tube, an inner sleeve, a left housing, a right housing and a connecting rod. The support tube is provided on a top portion of the support base. The inner sleeve is provided in the support tube. The left housing is provided on a top portion of the inner sleeve. The right housing is provided at a right side of the left housing. The connecting rod is provided beneath the right housing. An upper enclosure frame is provided between the right housing of the left support mechanism and the right housing of the right support mechanism. A support frame is provided between a bottom portion of the connecting rod of the left support mechanism and a bottom portion of the connecting rod of the right support mechanism.

11 Claims, 12 Drawing Sheets

(56) References Cited

U.S. PATENT DOCUMENTS

| | | | | |
|---|---|---|---|---|
| 2018/0192784 | A1* | 7/2018 | Yang | A47D 9/012 |
| 2018/0206651 | A1* | 7/2018 | Gallina | A47D 9/005 |
| 2019/0328151 | A1* | 10/2019 | Sclare | A47D 9/016 |
| 2021/0212478 | A1* | 7/2021 | Yang | A47D 9/012 |
| 2022/0330713 | A1* | 10/2022 | Yang | A47D 9/00 |
| 2022/0330714 | A1* | 10/2022 | Yang | A47D 9/02 |

* cited by examiner

MULTIFUNCTIONAL CRIB

CROSS REFERENCE TO THE RELATED APPLICATIONS

This application is based upon and claims priority to Chinese Patent Application No. 202123356255.6, filed on Dec. 29, 2021, the entire contents of which are incorporated herein by reference.

TECHNICAL FIELD

The present invention relates to the field of children's products, in particular to a multifunctional crib.

BACKGROUND

Cribs are specially designed for infants. The existing cribs have various styles, and their functions and prices vary greatly. The existing cribs are divided into fixed type and cradle type cribs, both of which have the problems of single function and lack of user-friendly design. In view of this, the present invention proposes a multifunctional crib, which enriches the functions of the crib and integrates a user-friendly design to the crib so as to meet actual use requirements.

SUMMARY

In order to solve the problem of single function of the existing cribs, an objective of the present invention is to provide a multifunctional crib.

To solve the above technical problem, the present invention adopts the following technical solution:

A multifunctional crib includes a left support mechanism and a right support mechanism that are symmetrical to each other, where each of the left support mechanism and the right support mechanism includes a support base, a support tube, an inner sleeve, a left housing, a right housing and a connecting rod; the support tube is provided on a top portion of the support base; the inner sleeve is provided in the support tube; the left housing is provided on a top portion of the inner sleeve; the right housing is provided at a right side of the left housing; the connecting rod is provided beneath the right housing; the inner sleeve is height-adjustable relative to the support tube; the left housing and the right housing are able to rock relative to each other; a portion of the support base is retractable; an upper enclosure frame is provided between the right housing of the left support mechanism and the right housing of the right support mechanism; and a support frame is provided between a bottom portion of the connecting rod of the left support mechanism and a bottom portion of the connecting rod of the right support mechanism.

Further, a lower portion of the left housing may communicate with the inner sleeve; a bottom portion of the inner sleeve may be provided with a lifting box; the lifting box may be internally provided with a lifting piece and a clamping rod; the lifting piece may be configured to drive the clamping rod to move left and right; the lower portion of the left housing may be provided with a pulling assembly; a pulling rope may be provided between the pulling assembly and the lifting piece; a right side of the support tube may be provided with a plurality of clamping openings arranged vertically; and a right end of the clamping rod may pass through a right side of the lifting box to be clamped into the clamping opening.

Further, the lower portion of the left housing may be provided with an open slot and a first button slot; the pulling assembly may include a movable plate and a first button; a pulling portion may be provided on a left side of the movable plate; the pulling portion protrudes out of the open slot; the movable plate may be provided with a vertical slot penetrating left and right, and the vertical slot may be located beneath the pulling portion; a right end of the first button may be provided with a blocking portion, and a left end surface of the blocking portion is larger than a right end surface of the first button; a right end of the movable plate may be provided with a support step for supporting a bottom surface of the blocking portion; an accommodating slot may be provided in a right inner end surface of the left housing; a left end of the first button may pass through the vertical slot and the first button slot in sequence; a right end of the blocking portion may be located in the accommodating slot; and the accommodating slot may be internally provided with a first spring abutting against the right end of the blocking portion.

Further, a top portion of the lifting piece may be connected to the pulling rope, and a bottom portion of the lifting piece may be provided with a movement opening extending upwardly; the movement opening may be internally provided with a movable piece; two sides of the lifting piece may be respectively provided with inclined holes communicating with the movement opening, and two sides of the movable piece may be respectively provided with clamping posts; each of the clamping posts may be corresponding to and located in one inclined hole; the clamping rod may be connected to a right end of the movable piece; the lifting box may be internally provided with a second spring abutting against a top portion of the lifting piece; a left inner surface of the lifting box may be provided with a limiting post; a left end of the movable piece may be provided with a limiting hole adapted to the limiting post; the limiting post may be located in the limiting hole; and the limiting hole may be internally provided with a third spring abutting against the limiting post.

Further, a left end surface of the left housing may be provided with a second slot, and a left end surface of the right housing may be provided with a third slot; a right end of the left housing may be provided with two symmetrical rocking limiting slots, and the third slot may be internally provided with two symmetrical rocking limiting rods; each of the rocking limiting rods may be corresponding to one rocking limiting slot, and each of left ends of the rocking limiting rods may be located in the corresponding rocking limiting slot; the second slot may be internally provided with a second movement slot, and the third slot may be internally provided with a third movement slot; the left end surface of the left housing may be covered with a first end cover adapted to the second slot; a left end surface of the first end cover may be provided with a first sliding slot; the first sliding slot may be internally provided with a first sliding button that may be slidable left and right; the second movement slot may be internally provided with a first movable member, and the third movement slot may be internally provided with a second movable member; a plurality of first abutting posts may be evenly distributed at a right end surface of the first movable member, and the second movement slot may be internally provided with a plurality of post slots into which the plurality of first abutting posts extend; a plurality of second abutting posts may be evenly distributed at a left end surface of the second movable member; each of the plurality of second abutting posts may be corresponding to one first abutting post and one post slot, and left ends of the plurality of second abutting posts may protrude into the corresponding post slots to abut against the first abutting posts; the third movement slot may be internally provided with a fourth spring abutting against a right end surface of the second movable member; and the first sliding button may be connected to the first movable member, and the first sliding button may be able to be fixed to the first end cover after sliding.

Further, a right end surface of the first sliding button may be provided with a driving portion; the driving portion may be provided with a through slot penetrating vertically; an unlocking button may pass through the first sliding button; a left end of the unlocking button may protrude out of the first sliding button, and the other end of the unlocking button may be located in the through slot and provided with a vertical plate; top and bottom surfaces of the vertical plate may be respectively provided with first clamping portions; the through slot may be internally provided with a fifth spring abutting against the vertical plate; a right end surface of the driving portion defines a first inclined surface; a left end surface of the first movable member may be provided with a fourth movement slot; an end surface of the fourth movement slot defines a second inclined surface attached to the first inclined surface; a right end of the driving portion may be located in the fourth movement slot; a front end of the second inclined surface may be provided with a limiting portion; a right end surface of the first end cover may be provided with two abutting portions arranged vertically; the two abutting portions may be corresponding to the first clamping portions on the top and bottom surfaces of the vertical plate, respectively; and each of the first clamping portions abuts against two sides of each of the corresponding abutting portions.

Further, the second slot may be internally provided with two symmetrical first connecting posts, two symmetrical notches and two symmetrical clamping plates; each of the first connecting posts may be corresponding to one notch and one clamping plate, and each of the clamping plates may be located between the corresponding first connecting post and notch; the third slot may be internally provided with two symmetrical second connecting posts, and each of the second connecting posts may be corresponding to one notch; the second slot may be internally provided with two symmetrical centering springs; each of the centering springs may be corresponding to one first connecting post, one clamping plate, one notch and one second connecting post; and the centering spring may be provided with one end connected to the first connecting post, a central portion clamped to the clamping plate, and the other end passing through the notch and connected to the second connecting post.

Further, the support base may include a front arc rod, a rear arc rod and a connecting piece; the connecting piece may be provided between a top end of the front arc rod and a top end of the rear arc rod; a bottom portion of the support tube may be connected to the connecting piece; the front arc rod may include an upper arc rod and a lower arc rod; a bottom end of the upper arc rod may be provided with a lower housing; the lower housing may be internally provided with a second sliding slot with a bottom opening; a left end surface of the lower housing may be provided with a cover slot; the cover slot may be internally provided with a second button; the cover slot may be covered with a second end cover adapted to the cover slot; the cover slot may be provided with an upper hinge portion and a lower hinge portion; the second button may be located between the upper hinge portion and the lower hinge portion; a middle portion of the second button may be hinged to the upper hinge portion and the lower hinge portion; a rear portion of a left end surface of the second button may be provided with a pressing portion, and the pressing portion may pass through a left end surface of the second end cover; a sixth spring may be provided between a rear portion of a right end surface of the second button and the cover slot; the lower housing may be internally provided with an angle iron piece, and the angle iron piece may be in an inverted U shape; left and right sides of the angle iron piece may be respectively provided with strip slots; a sliding portion may be provided on a top portion of the lower arc rod; the sliding portion may be located in the angle iron piece, and the sliding portion may be connected to the angle iron piece by a rivet; the rivet may pass through the sliding portion and the strip slots on the left and right sides of the angle iron piece; a left end of the rivet may be able to abut against a front end of the second button; and the second sliding slot may be internally provided with a seventh spring abutting against the sliding portion.

Further, the upper enclosure frame may include a U-shaped tube, a left connecting tube, a right connecting tube and a detachable tube; two ends of the U-shaped tube may respectively pass through the right housing of the left support mechanism and the right housing of the right support mechanism to be respectively connected to the left connecting tube and the right connecting tube; and the detachable tube may be detachably provided between the left connecting tube and the right connecting tube.

Further, each of two ends of the detachable tube may be internally provided with a third movable member and an eighth spring; the third movable member may have a bottom portion provided with a push portion, one end surface provided with an insertion rod, and the other end surface abutting against the eighth spring; an end surface of each of the left connecting tube and the right connecting tube may be provided with an insertion slot for an insertion of the insertion rod; an end portion of each of the left connecting tube and the right connecting tube may be provided with a positioning portion; and each of two ends of the detachable tube may be provided with a positioning slot adapted to the positioning portion.

Further, the bottom portion of the connecting rod of the left support mechanism and the bottom portion of the connecting rod of the right support mechanism may be respectively provided with clamping members; and the support frame may be provided between the clamping member of the left support mechanism and the clamping member of the right support mechanism.

According to the description of the present invention, compared with the prior art, the present invention has the following advantages. The present invention has a novel structure and smarter design. The inner sleeve is height-adjustable to meet the requirements of people for different usage heights of the crib. The left housing and the right housing can be relatively fixed or rocked. When the left housing and the right housing are relatively rocked, the crib offers a rocking function, which is convenient for coaxing the baby to sleep. In addition, a portion of the support base is retractable, such that the crib can be placed closer to the adult bed, which is convenient for parents to take care of the baby. Through improvement, the crib of the present invention has rich functions and user-friendly design.

DETAILED DESCRIPTION OF THE EMBODIMENTS

Figure 1:
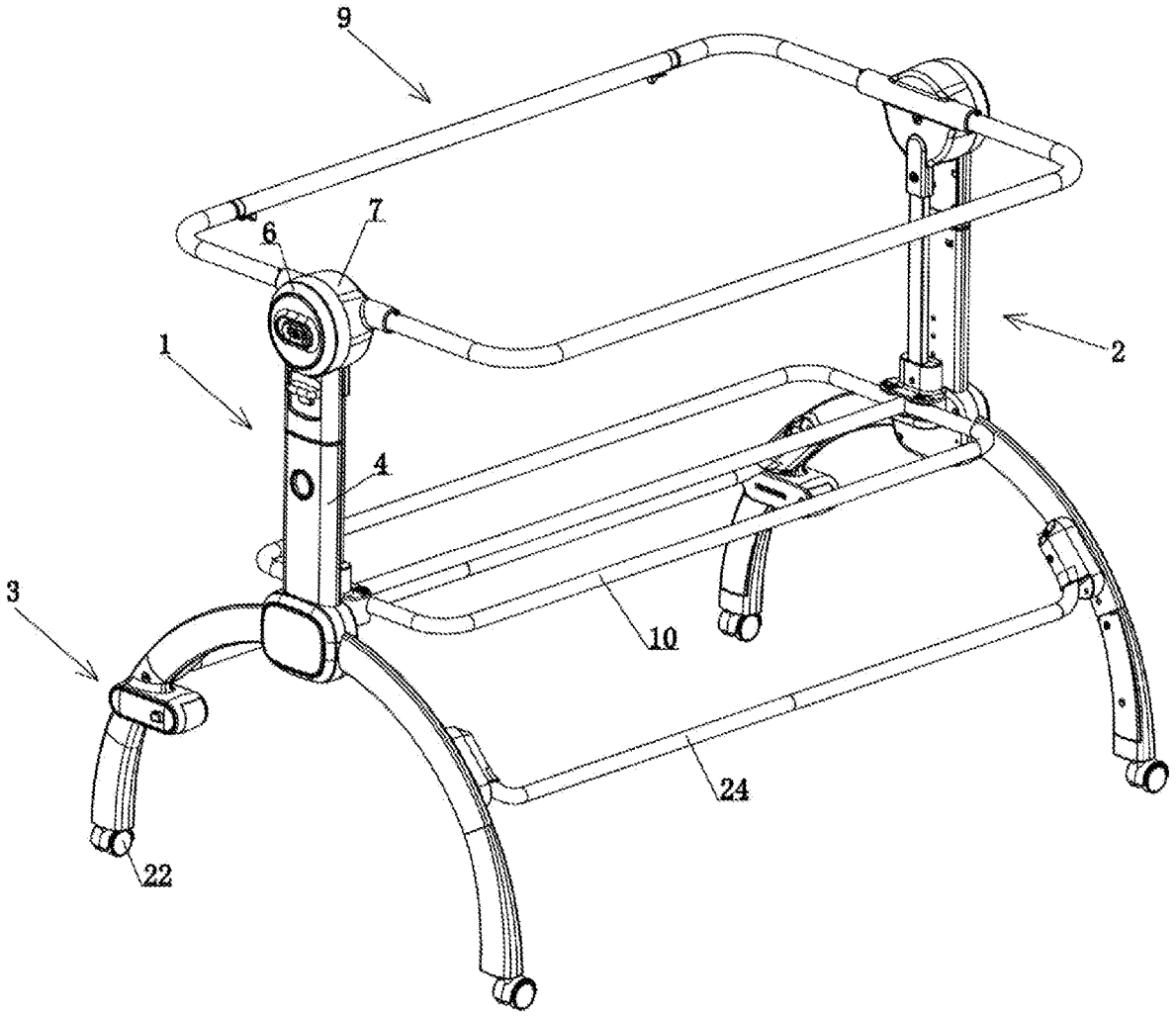
FIG. 1 is a structural view of a multifunctional crib according to the present invention.
Figure 2:
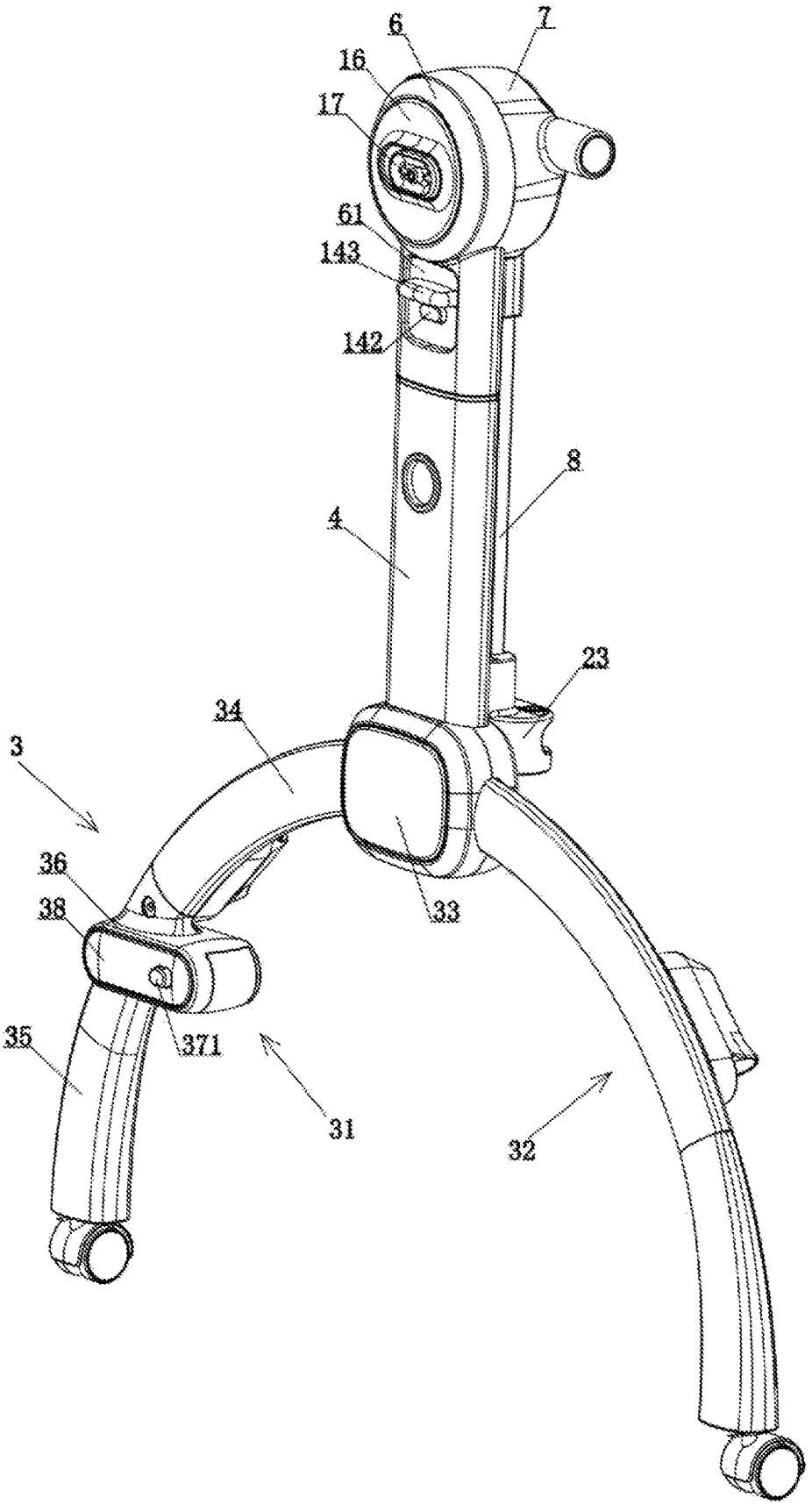
FIG. 2 is a structural view of a left support mechanism according to the present invention.
Figure 3:
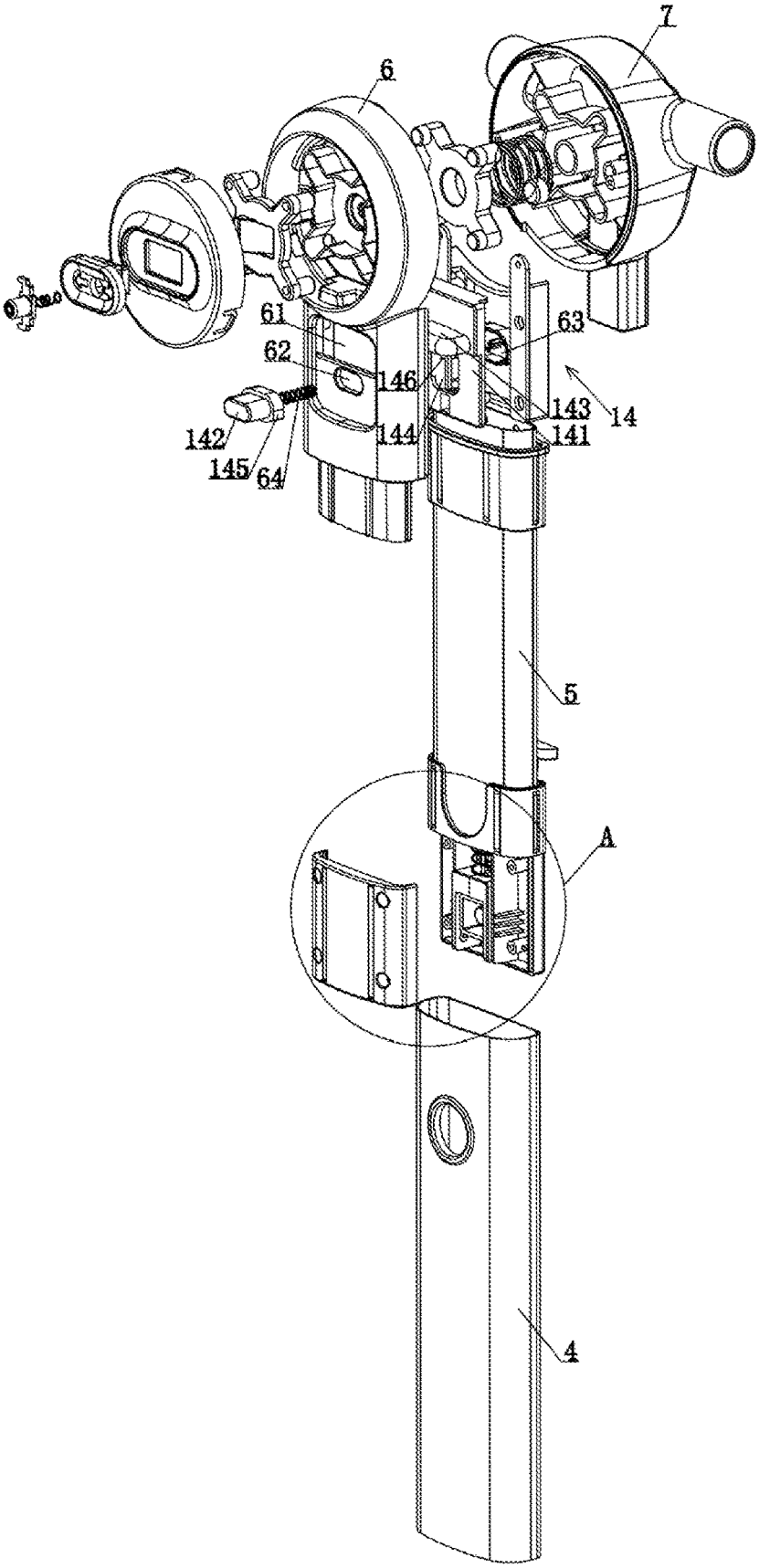
FIG. 3 is a partial exploded view of the left support mechanism according to the present invention.
Figure 4:
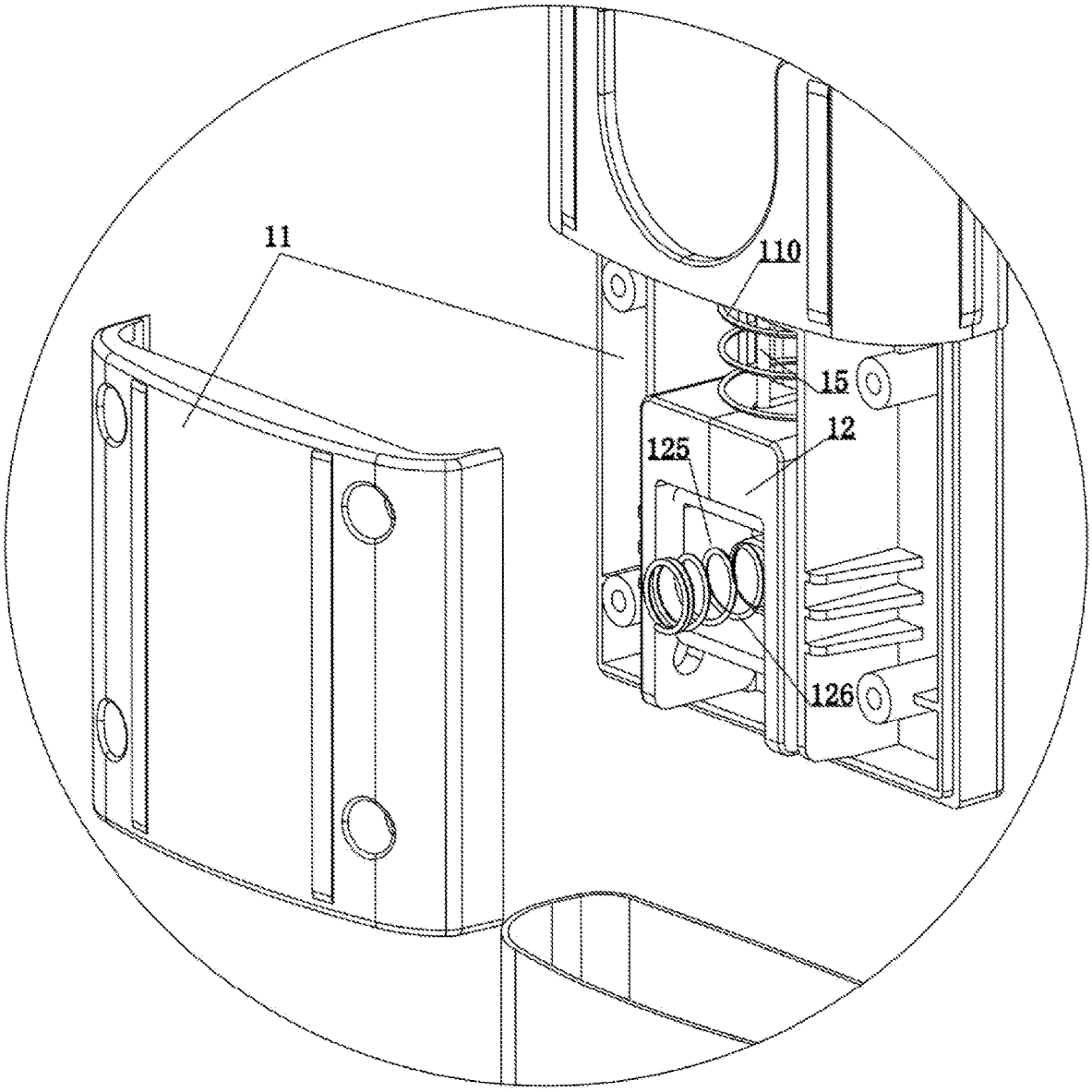
FIG. 4 is a partial enlarged view of A shown in FIG. 3.
Figure 5:
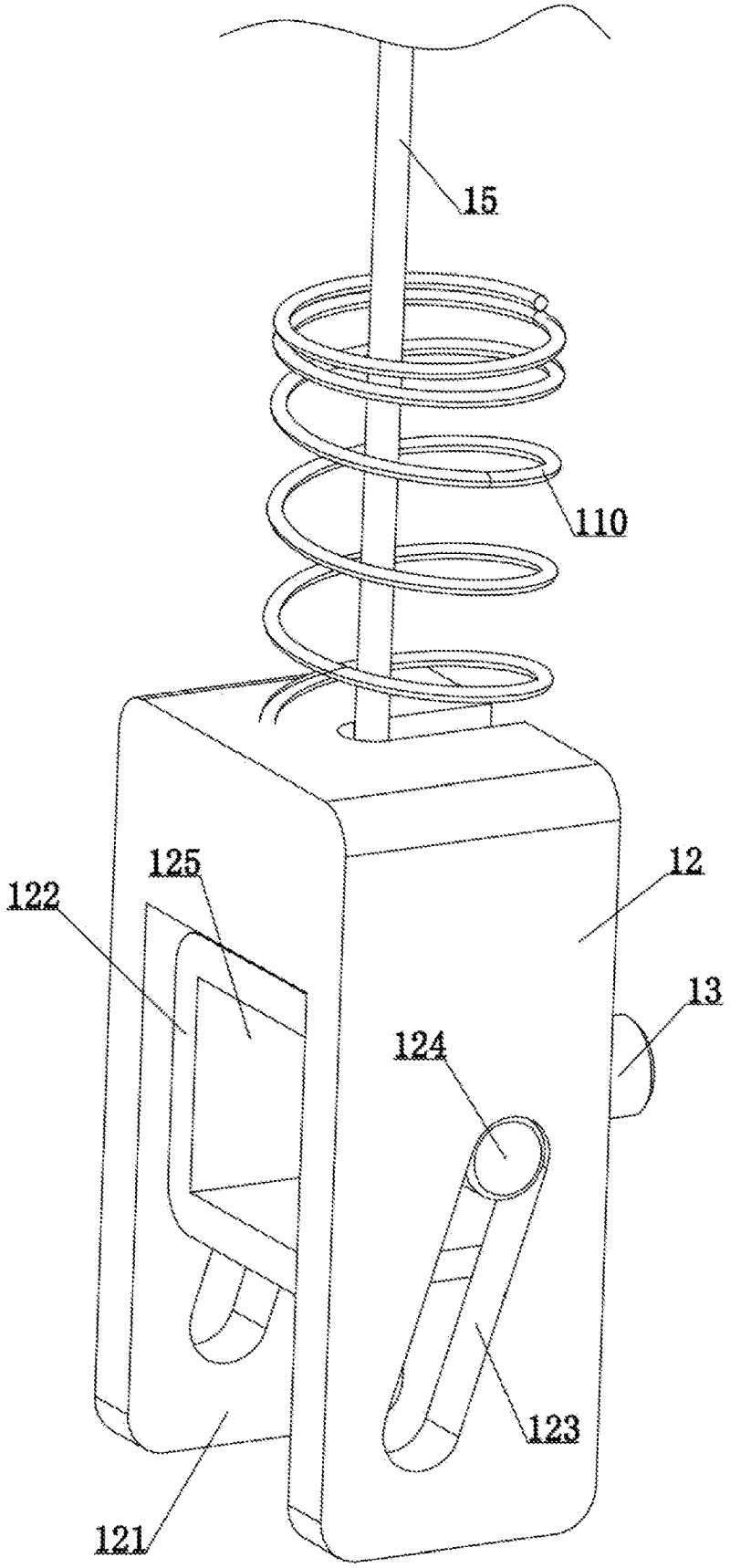
FIG. 5 is a structural view of a lifting piece connected to a clamping rod according to the present invention.
Figure 6:
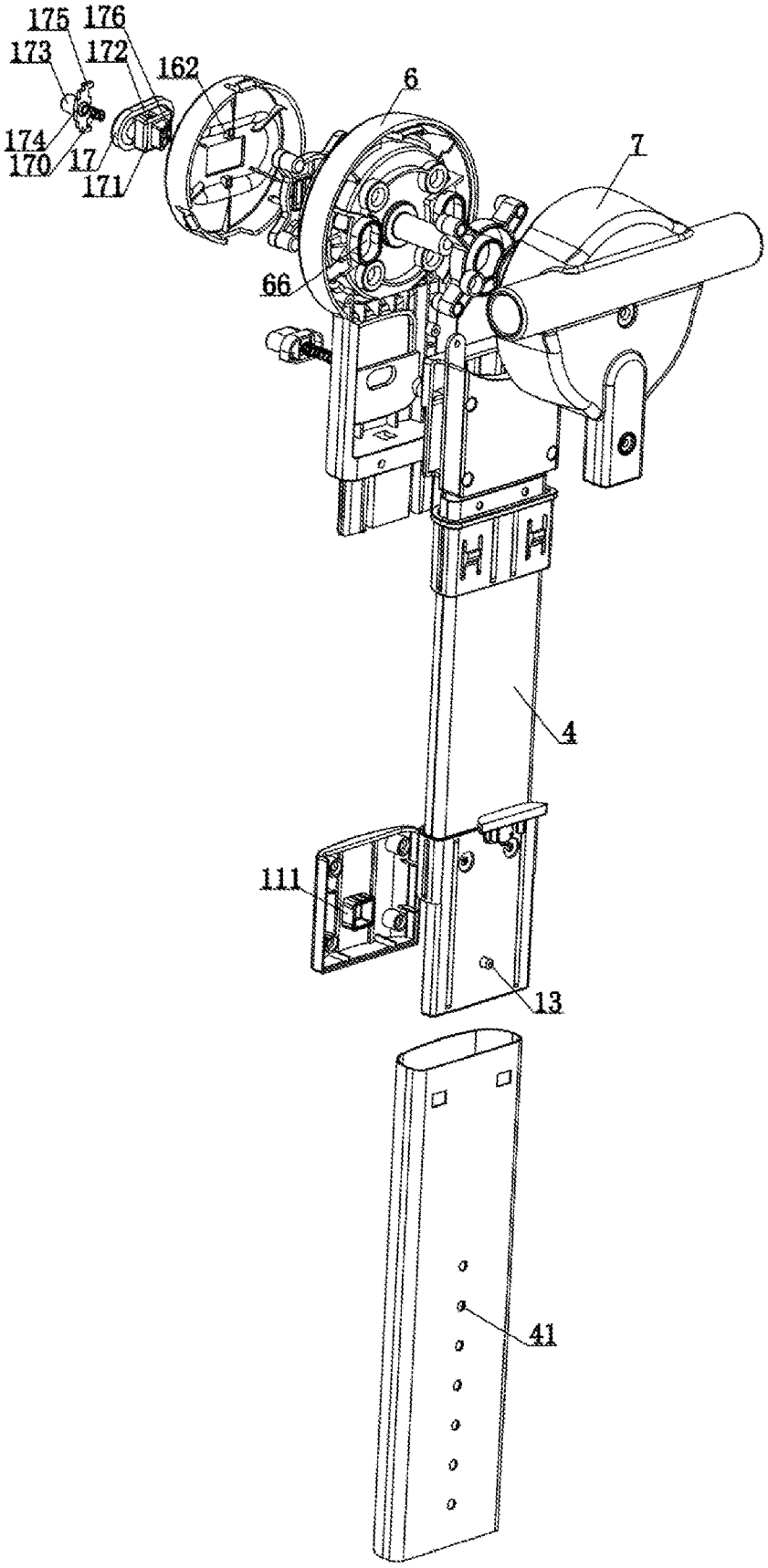
FIG. 6 is a partial exploded view of the left support mechanism shown in FIG. 3 from another perspective.
Figure 7:
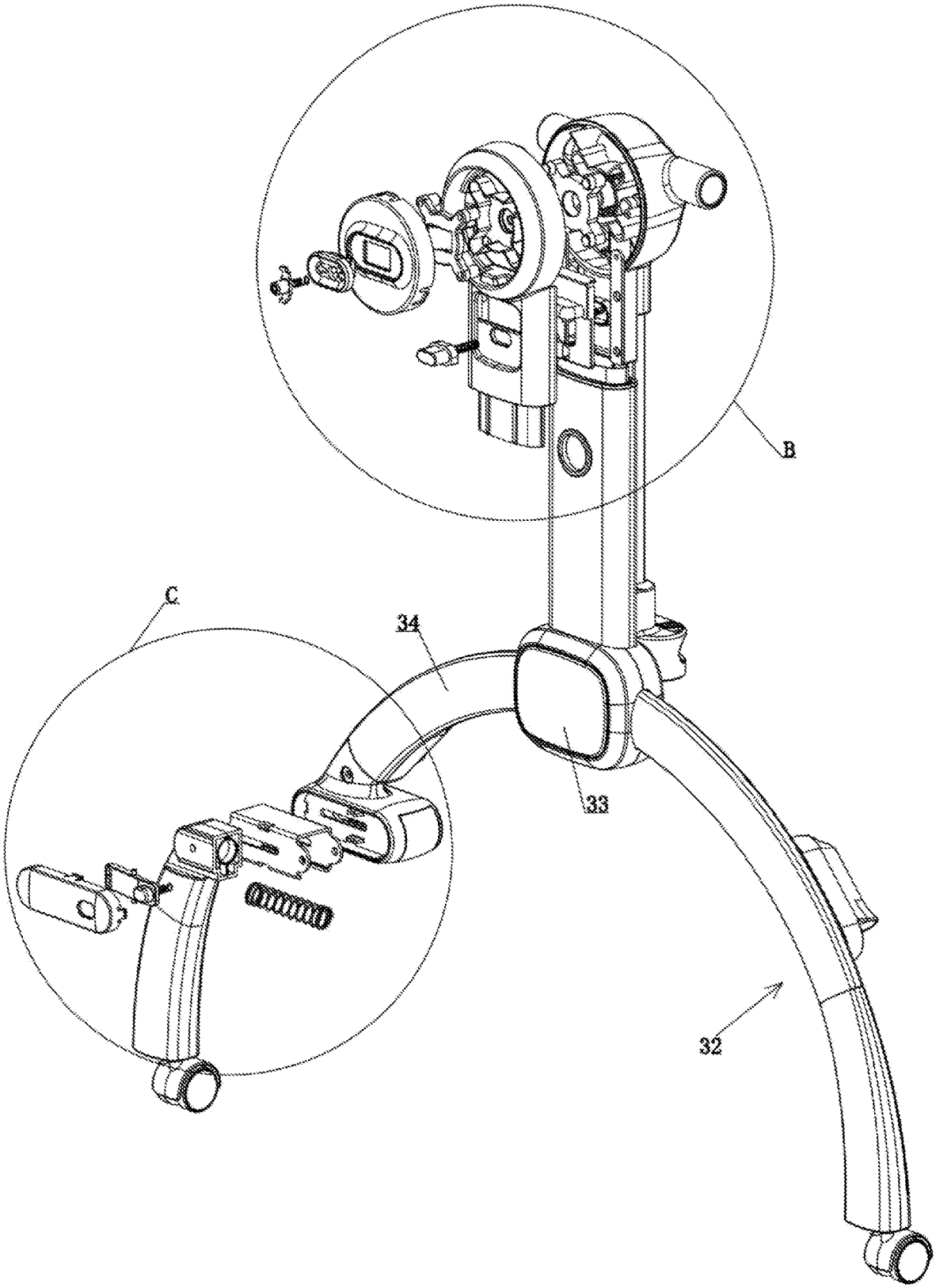
FIG. 7 is an exploded view of the left support mechanism according to the present invention.

Referring to FIGS. 1 to 3, a multifunctional crib includes a left support mechanism 1 and a right support mechanism 2 that are symmetrical to each other. Each of the left support mechanism 1 and the right support mechanism 2 includes a support base 3, a support tube 4, an inner sleeve 5, a left housing 6, a right housing 7 and a connecting rod 8. The support tube 4 is provided on a top portion of the support base 3. The inner sleeve 5 is provided in the support tube 4. The left housing 6 is provided on a top portion of the inner sleeve 5. The right housing 7 is provided at a right side of the left housing 6 and is connected to the left housing 6. The connecting rod 8 is provided beneath the right housing 7. The inner sleeve 5 is height-adjustable relative to the support tube 4. The left housing 6 and the right housing 7 are able to rock relative to each other. A portion of the support base 3 is retractable. An upper enclosure frame 9 is provided between the right housing 7 of the left support mechanism 1 and the right housing 7 of the right support mechanism 2. A support frame 10 is provided between a bottom portion of the connecting rod 8 of the left support mechanism 1 and a bottom portion of the connecting rod 8 of the right support mechanism 2.

Referring to FIGS. 2 to 6, a lower portion of the left housing 6 communicates with the inner sleeve 5. A bottom portion of the inner sleeve 5 is provided with a lifting box 11. The lifting box 11 is internally provided with a lifting piece 12 and a clamping rod 13. The lifting piece 12 is configured to drive the clamping rod 13 to move left and right. The lower portion of the left housing 6 is provided with a pulling assembly 14. A pulling rope 15 is provided between the pulling assembly 14 and the lifting piece 12. A right side of the support tube 4 is provided with a plurality of clamping openings 41 arranged vertically. A right end of the clamping rod 13 passes through a right side of the lifting box 11 to be clamped into the clamping opening 41.

Referring to FIGS. 2 to 6, the lower portion of the left housing 6 is provided with an open slot 61 and a first button slot 62. The pulling assembly 14 includes a movable plate 141 and a first button 142. A pulling portion 143 is provided on a left side of the movable plate 141. The pulling portion 143 protrudes out of the open slot 61. The movable plate 141 is provided with a vertical slot 144 penetrating left and right, and the vertical slot 144 is located beneath the pulling portion 143. A right end of the first button 142 is provided with a blocking portion 145, and a left end surface of the blocking portion 145 is larger than a right end surface of the first button 142. A right end of the movable plate 141 is provided with a support step 146 for supporting a bottom surface of the blocking portion 145. An accommodating slot 63 is provided in a right inner end surface of the left housing 6. A left end of the first button 142 passes through the vertical slot 144 and the first button slot 62 in sequence, and a right end of the blocking portion 145 is located in the accommodating slot 63. The accommodating slot 63 is internally provided with a first spring 64 abutting against the right end of the blocking portion.

Referring to FIGS. 3 to 6, a top portion of the lifting piece 12 is connected to the pulling rope 15, and a bottom portion of the lifting piece 12 is provided with a movement opening 121 extending upwardly. The movement opening 121 is internally provided with a movable piece 122. Two sides of the lifting piece 12 are respectively provided with inclined holes 123 communicating with the movement opening 121, and two sides of the movable piece 122 are respectively provided with clamping posts 124. Each of the clamping posts 124 is corresponding to and located in one inclined hole 123. The clamping rod 13 is connected to a right end of the movable piece 122. The lifting box 11 is internally provided with a second spring 110 abutting against a top portion of the lifting piece 12. A left inner surface of the lifting box 11 is provided with a limiting post 111. A left end of the movable piece 122 is provided with a limiting hole 125 adapted to the limiting post 111. The limiting post 111 is located in the limiting hole 125. The limiting hole 125 is internally provided with a third spring 126 abutting against the limiting post 111.

Referring to FIGS. 2 to 6, when the height of the inner sleeve 5 needs to be adjusted, first, the first button 142 is pressed to disengage the first button from the first button slot 62. Then, the pulling portion 143 is pulled upward, such that the movable plate 141 pulls the lifting piece 12 upward through the pulling rope 15. When the lifting piece 12 is raised, the clamping rod 13 moves to the left, such that the clamping rod 13 is disengaged from the matched clamping opening 41. At this time, the height of the inner sleeve 5 can be adjusted. After the adjustment of the height of the inner sleeve 5 is completed, the pulling portion 143 is released, such that the pulling portion 143 returns to the first button slot 62. The first button 142 is re-clamped, and the clamping rod 13 is re-clamped into a new clamping opening 41.

Referring to FIGS. 2, 6, 7 and 8, a left end surface of the left housing 6 is provided with a second slot 65, and a left end surface of the right housing 7 is provided with a third slot 71. A right end of the left housing 6 is provided with two symmetrical rocking limiting slots 66, and the third slot 71 is internally provided with two symmetrical rocking limiting rods 72. Each of the rocking limiting rods 72 is corresponding to one rocking limiting slot 66, and each of left ends of the rocking limiting rods 72 is located in the corresponding rocking limiting slot 66. The second slot 65 is internally provided with a second movement slot 67, and the third slot 71 is internally provided with a third movement slot 73. The left end surface of the left housing 6 is covered with a first end cover 16 adapted to the second slot 65. A left end surface of the first end cover 16 is provided with a first sliding slot 161. The first sliding slot 161 is internally provided with a first sliding button 17 that is slidable left and right. The second movement slot 67 is internally provided with a first movable member 18, and the third movement slot 73 is internally provided with a second movable member 19. A plurality of first abutting posts 181 are evenly distributed at a right end surface of the first movable member 18, and the second movement slot 67 is internally provided with a plurality of post slots 68 into which the plurality of first abutting posts 181 extend. A plurality of second abutting posts 191 are evenly distributed at a left end surface of the second movable member 19. Each of the plurality of second abutting posts 191 is corresponding to one first abutting post 181 and one post slot 68, and left ends of the plurality of second abutting posts 191 protrude into the corresponding post slots 68 to abut against the first abutting posts 181. The third movement slot 73 is internally provided with a fourth spring 74 abutting against a right end surface of the second movable member 19. The first sliding button 17 is connected to the first movable member 18, and the first sliding button 17 is able to be fixed to the first end cover 16 after sliding.

Figure 8:
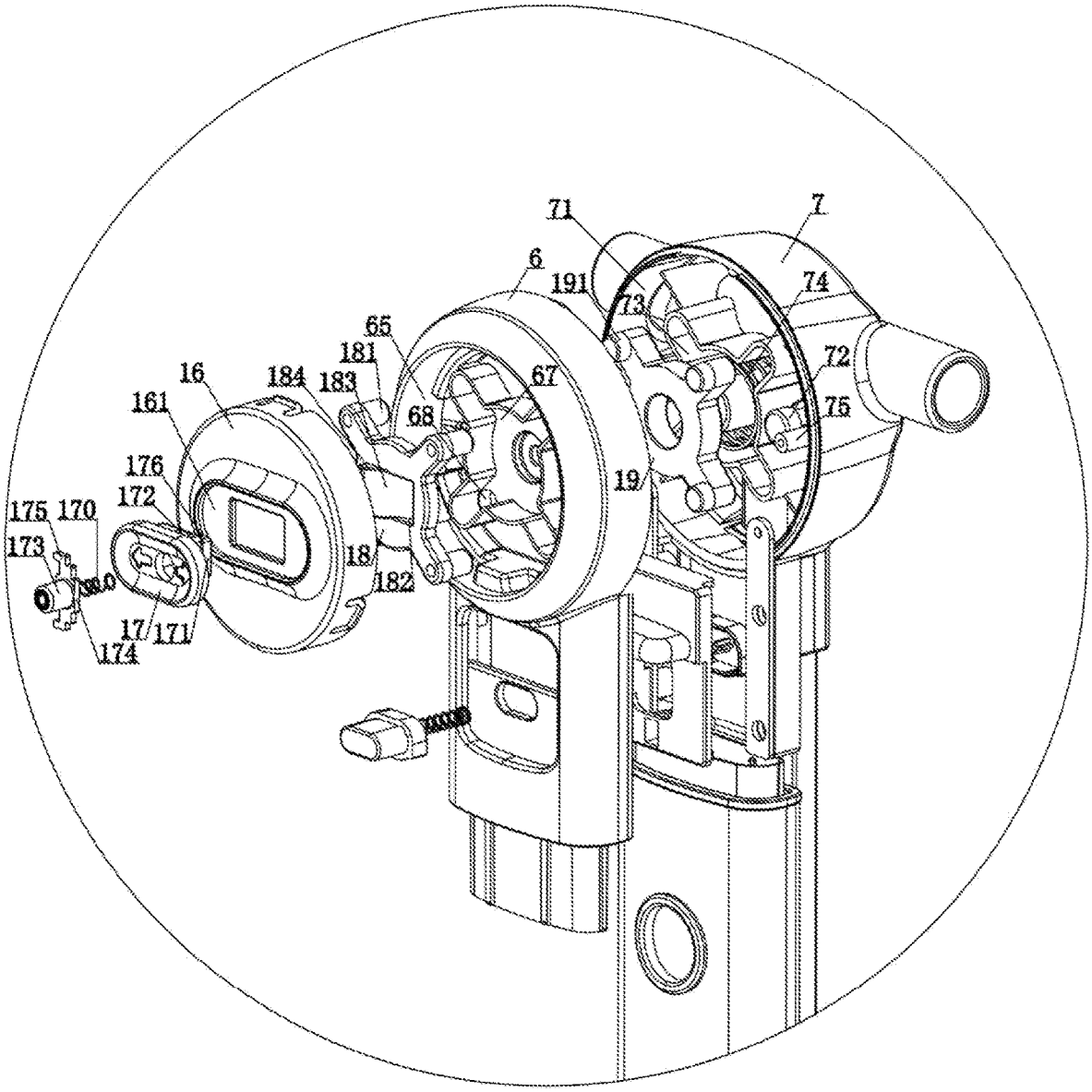
FIG. 8 is a partial enlarged view of B shown in FIG. 7.
Figure 9:
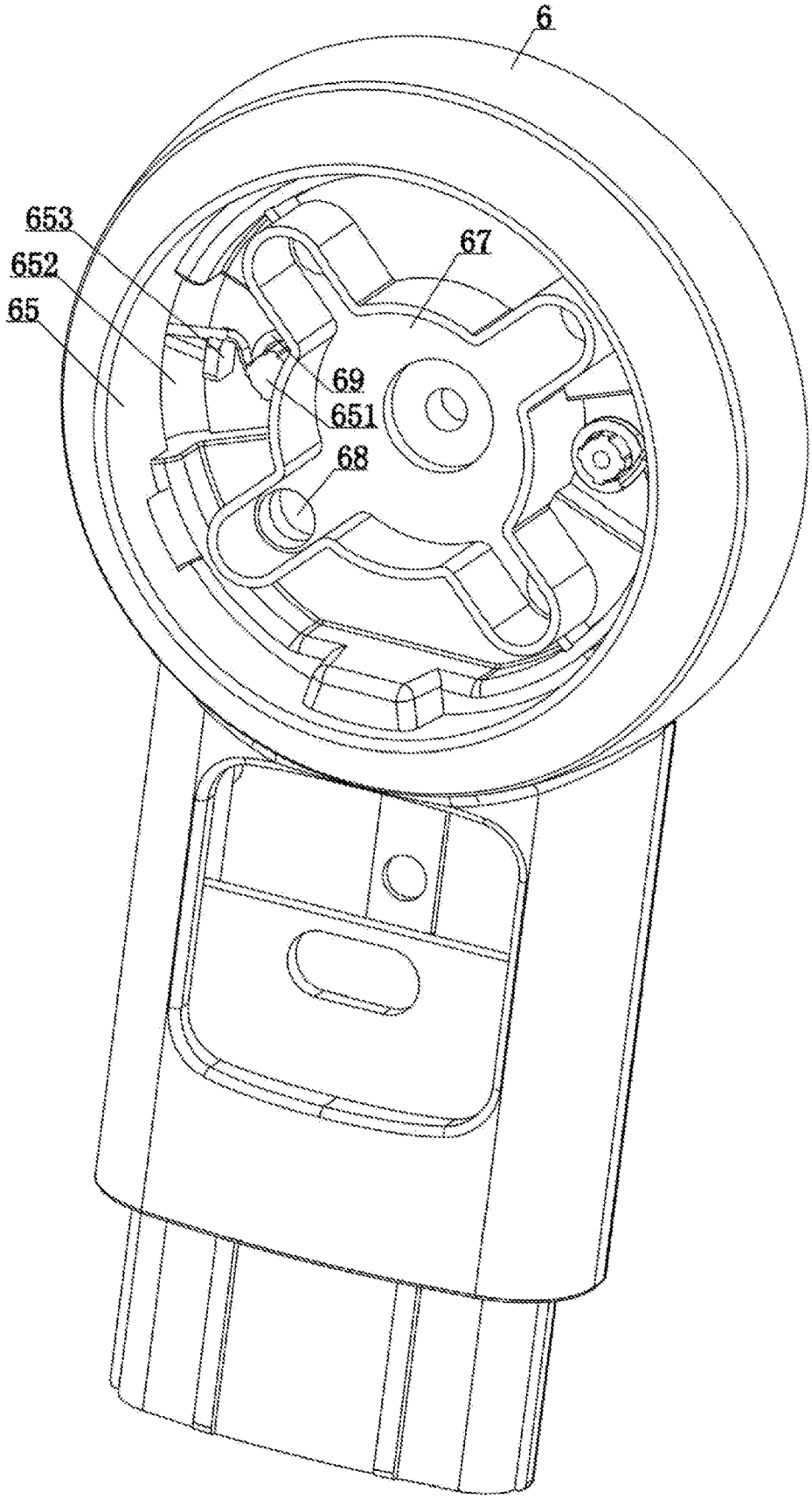
FIG. 9 is a structural view of a left housing according to the present invention.
Figure 10:
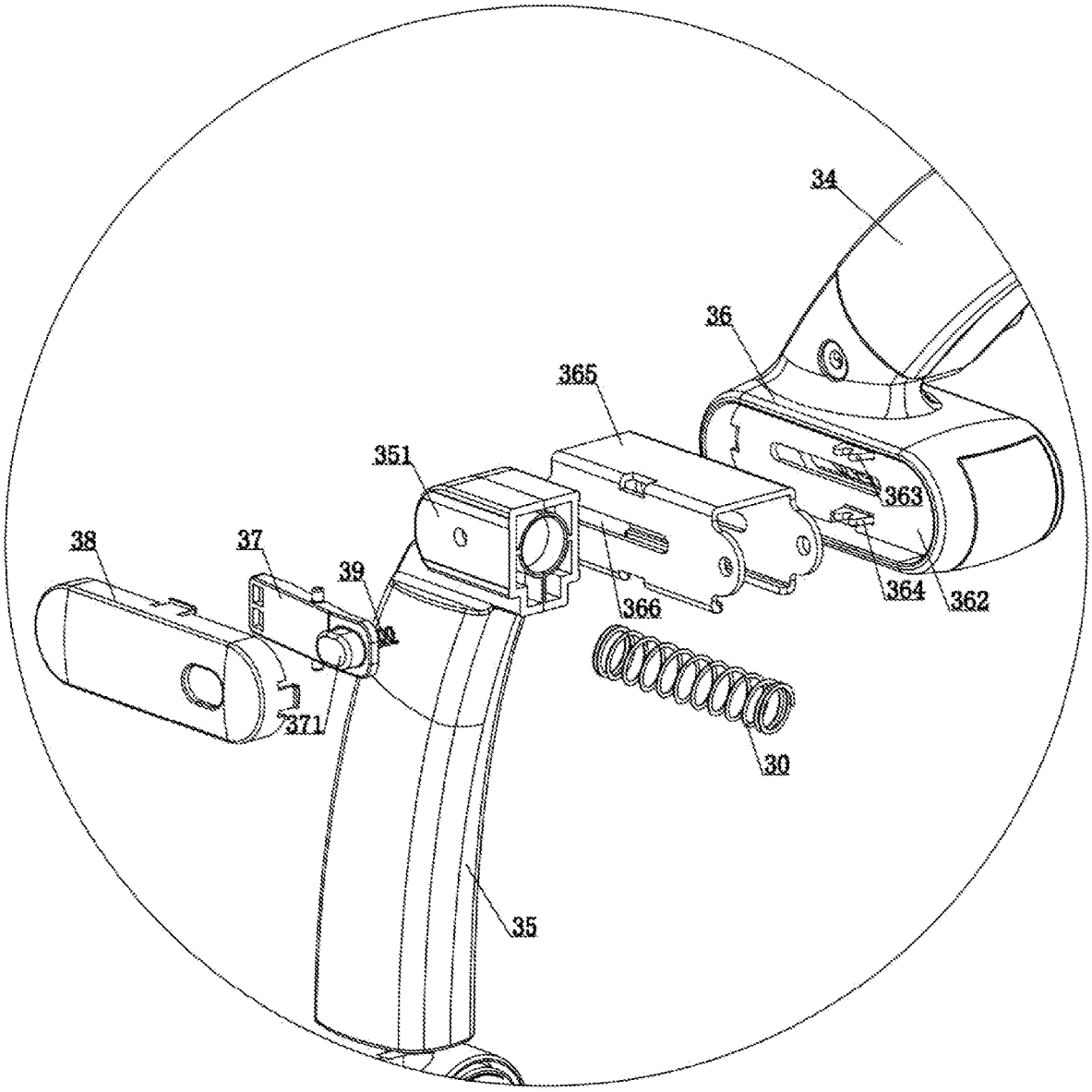
FIG. 10 is a partial enlarged view of C shown in FIG. 7.
Figure 11:
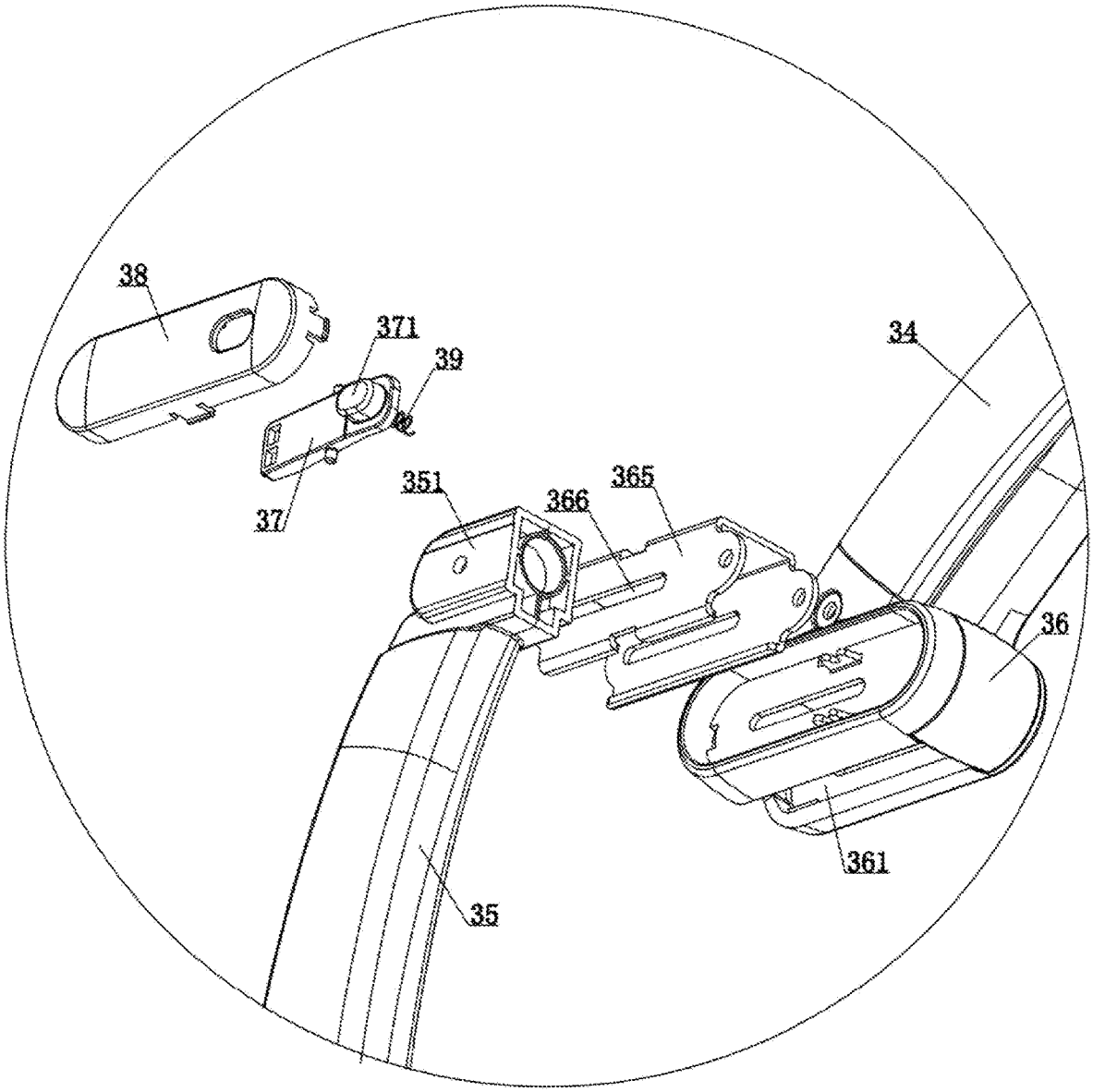
FIG. 11 is a partial enlarged view of C shown in FIG. 10 from another perspective.

Referring to FIGS. 8 and 9, the second slot 65 is internally provided with two symmetrical first connecting posts 651, two symmetrical notches 652 and two symmetrical clamping plates 653. Each of the first connecting posts 651 is corresponding to one notch 652 and one clamping plate 653, and each of the clamping plates 653 is located between the corresponding first connecting post 651 and notch 652. The third slot 71 is internally provided with two symmetrical second connecting posts 75, and each of the second connecting posts 75 is corresponding to one notch 652. The second slot 65 is internally provided with two symmetrical centering springs 69. Each of the centering springs 69 is corresponding to one first connecting post 651, one clamping plate 653, one notch 652 and one second connecting post 75. The centering springs 69 is provided with one end connected to the first connecting post 651, a central portion clamped to the clamping plate 653, and the other end passing through the notch 652 and connected to the second connecting post 75.

Referring to FIGS. 2, 6, 7 and 8, a right end surface of the first sliding button 17 is provided with a driving portion 171. The driving portion 171 is provided with a through slot 172 penetrating vertically. An unlocking button 173 passes through the first sliding button 17. A left end of the unlocking button 17 protrudes out of the first sliding button 17, and the other end of the unlocking button 17 is located in the through slot 172 and provided with a vertical plate 174. Top and bottom surfaces of the vertical plate 174 are respectively provided with first clamping portions 175. The through slot 172 is internally provided with a fifth spring 170 abutting against the vertical plate 174. A right end surface of the driving portion 171 defines a first inclined surface 176. A left end surface of the first movable member 18 is provided with a fourth movement slot 182. An end surface of the fourth movement slot 182 defines a second inclined surface 183 attached to the first inclined surface 176. A right end of the driving portion 171 is located in the fourth movement slot 182. A front end of the second inclined surface 183 is provided with a limiting portion 184. A right end surface of the first end cover 16 is provided with two abutting portions 162 arranged vertically. The two abutting portions 162 are corresponding to the first clamping portions 175 on the top and bottom surfaces of the vertical plate 174, respectively, and each of the first clamping portions 175 abuts against two sides of each of the corresponding abutting portions 162.

Referring to FIGS. 2, 6, 7, 8 and 9, to rock the left housing 6 and the right housing 7 relatively, the unlocking button 173 is pressed such that the first clamping portions 175 are disengaged from the abutting portions 162. Then, the first sliding button 17 is slid forward. The first inclined surface 176 cooperates with the second inclined surface 183, such that when the first sliding button 17 is slid forward, the first movable member 18 moves to the right, and the first abutting posts 181 of the first movable member 18 always abut against the second abutting posts 191. When the first sliding button 17 is slid in place, the unlocking button 173 is released, such that the first clamping portions 175 abut against the abutting portions 162, thereby fixing the first sliding button 17. At this time, the left housing 6 and the right housing 7 can be rocked relative to each other. The two centering springs 69 make the right housing 7 center quickly and automatically when no external rocking force is applied. To fix the left housing 6 and the right housing 7 relatively, the unlocking button 173 is pressed, such that the first clamping portions 175 are disengaged from the abutting portions 162. Then, the first sliding button 17 is slid rearward to make the first sliding button 17, the first movable member 18 and the second movable member 19 return to their original positions. When the first sliding button 17, the first movable member 18 and the second movable member 19 return to their original positions, the unlocking button 173 is released, such that the first clamping portions 175 abut against the abutting portions 162. At this time, the left housing 6 and the right housing 7 can be relatively fixed.

Referring to FIGS. 1, 2, 7, 10 and 11, the support base 3 includes a front arc rod 31, a rear arc rod 32 and a connecting piece 33. The connecting piece 33 is provided between a top end of the front arc rod 31 and a top end of the rear arc rod 32. A bottom portion of the support tube 4 is connected to the connecting piece 33. The front arc rod 31 includes an upper arc rod 34 and a lower arc rod 35. A bottom end of the upper arc rod 34 is provided with a lower housing 36. The lower housing 36 is internally provided with a second sliding slot 361 with a bottom opening. A left end surface of the lower housing 36 is provided with a cover slot 362. The cover slot 362 is internally provided with a second button 37. The cover slot 362 is covered with a second end cover 38 adapted to the cover slot. The cover slot 362 is provided with an upper hinge portion 363 and a lower hinge portion 364. The second button 37 is located between the upper hinge portion 363 and the lower hinge portion 364. A middle portion of the second button 37 is hinged to the upper hinge portion 363 and the lower hinge portion 364. A rear portion of a left end surface of the second button 37 is provided with a pressing portion 371, and the pressing portion 371 passes through a left end surface of the second end cover 38. A sixth spring 39 is provided between a rear portion of a right end surface of the second button 37 and the cover slot 362. The lower housing 36 is internally provided with an angle iron piece 365, and the angle iron piece 365 is in an inverted U shape. Left and right sides of the angle iron piece 365 are respectively provided with strip slots 366. A sliding portion 351 is provided on a top portion of the lower arc rod 35. The sliding portion 351 is located in the angle iron piece 365. The sliding portion 351 is connected to the angle iron piece 365 by a rivet (not shown in the figure). The rivet (not shown in the figure) passes through the sliding portion 351 and the strip slots 366 on the left and right sides of the angle iron piece 365. A left end of the rivet (not shown in the figure) is able to abut against a front end of the second button 37. The second sliding slot 361 is internally provided with a seventh spring 30 abutting against the sliding portion 351. When in use, the front arc rod 31 is close to an adult bed. When the pressing portion 371 is pressed, a front portion of the second button 37 moves to the left, such that the left end of the rivet (not shown in the figure) is disengaged from the second button 37. At this time, the lower arc rod 35 can move rearward. When the lower arc rod 35 moves rearward in place, the pressing portion 371 is released. Then, the front arc rod 31 is tied to the adult bed with a strap. Thus, the crib is closer to the adult bed. Casters 22 are respectively provided at a bottom portion of the front arc rod 31 and a bottom portion of the lower arc rod 35.

Figure 12:
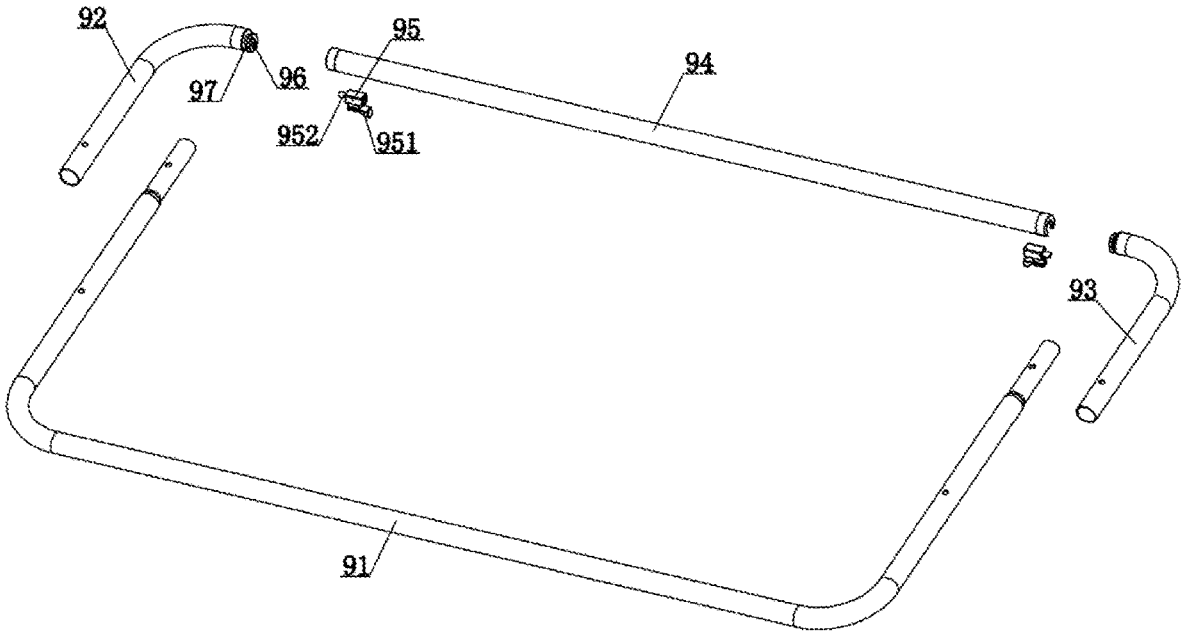
FIG. 12 is an exploded view of an upper enclosure frame according to the present invention.
Figure 13:
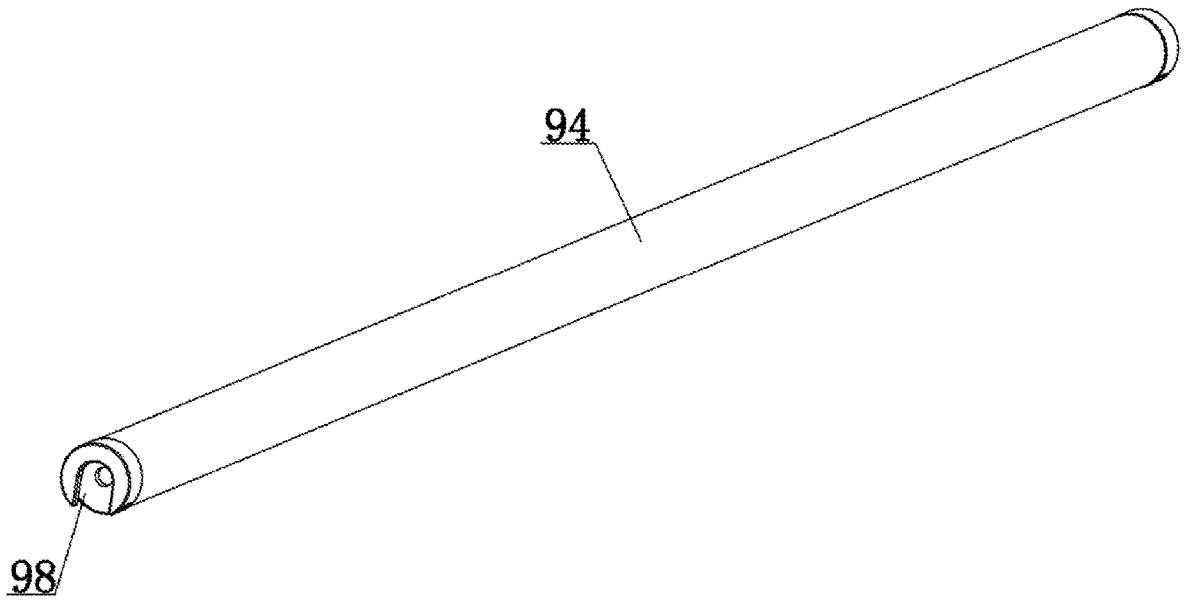
FIG. 13 is a structural view of a detachable tube according to the present invention.

Referring to FIGS. 1, 12 and 13, the upper enclosure frame 9 includes a U-shaped tube 91, a left connecting tube 92, a right connecting tube 93 and a detachable tube 94. Two ends of the U-shaped tube 91 respectively pass through the right housing 7 of the left support mechanism 1 and the right housing 7 of the right support mechanism 2 to be respectively connected to the left connecting tube 92 and the right connecting tube 93. The detachable tube 94 is detachably provided between the left connecting tube 92 and the right connecting tube 93. Each of two ends of the detachable tube 94 is internally provided with a third movable member 95 and an eighth spring (not shown in the figure). The third movable member 95 has a bottom portion provided with a push portion 951, one end surface provided with an insertion rod 952, and the other end surface abutting against the eighth spring (not shown in the figure). An end surface of each of the left connecting tube 92 and the right connecting tube 93 is provided with an insertion slot 96 for the insertion of the insertion rod. An end portion of each of the left connecting tube 92 and the right connecting tube 93 is provided with a positioning portion 97. Each of two ends of the detachable tube 94 is provided with a positioning slot 98 adapted to the positioning portion 97. The detachable tube 94 can be detached from the left connecting tube 92 and the right connecting tube 93. To do so, first, the push portions 951 are pushed to disengage the insertion rods 952 from the insertion slots 96. Then, the detachable tube 94 is raised such that the positioning portions 97 are disengaged from the positioning slots 98.

Referring to FIGS. 1 and 2, the bottom portion of the connecting rod 8 of the left support mechanism 1 and the bottom portion of the connecting rod 8 of the right support mechanism 2 are respectively provided with clamping members 23. The support frame 10 is provided between the clamping member 23 of the left support mechanism 1 and the clamping member 23 of the right support mechanism 2. Reinforcing rods 24 are provided between the support base 3 of the left support mechanism 1 and the support base 3 of the right support mechanism 2.

The above described are merely specific implementations of the present invention, but the design concept of the present invention is not limited thereto. Any non-substantial changes made to the present invention based on the concept of the present invention should fall within the protection scope of the present invention.

What is claimed is:

1. A multifunctional crib, comprising a left support mechanism and a right support mechanism, wherein the left support mechanism and the right support mechanism are symmetrical to each other, each of the left support mechanism and the right support mechanism comprises a support base, a support tube, an inner sleeve, a left housing, a right housing and a connecting rod; the support tube is provided on a top portion of the support base; the inner sleeve is provided in the support tube; the left housing is provided on a top portion of the inner sleeve; the right housing is provided at a right side of the left housing; the connecting rod is provided beneath the right housing; the inner sleeve is height-adjustable relative to the support tube; the left housing and the right housing are configured to rock relative to each other; a portion of the support base is retractable; an upper enclosure frame is provided between the right housing of the left support mechanism and the right housing of the right support mechanism; and a support frame is provided between a bottom portion of the connecting rod of the left support mechanism and a bottom portion of the connecting rod of the right support mechanism.

2. The multifunctional crib according to claim 1, wherein a lower portion of the left housing communicates with the inner sleeve; a bottom portion of the inner sleeve is provided with a lifting box; the lifting box is internally provided with a lifting piece and a clamping rod; the lifting piece is configured to drive the clamping rod to move left and right; the lower portion of the left housing is provided with a pulling assembly; a pulling rope is provided between the pulling assembly and the lifting piece; a right side of the support tube is provided with a plurality of clamping openings arranged vertically; and a right end of the clamping rod passes through a right side of the lifting box to be clamped into a clamping opening of the plurality of clamping openings.

3. The multifunctional crib according to claim 2, wherein the lower portion of the left housing is provided with an open slot and a first button slot; the pulling assembly comprises a movable plate and a first button; a pulling portion is provided on a left side of the movable plate; the pulling portion protrudes out of the open slot; the movable plate is provided with a vertical slot penetrating left and right, and the vertical slot is located beneath the pulling portion; a right end of the first button is provided with a blocking portion, and a left end surface of the blocking portion is larger than a right end surface of the first button; a right end of the movable plate is provided with a support step for supporting a bottom surface of the blocking portion; an accommodating slot is provided in a right inner end surface of the left housing; a left end of the first button passes through the vertical slot and the first button slot in sequence; a right end of the blocking portion is located in the accommodating slot; and the accommodating slot is internally provided with a first spring abutting against the right end of the blocking portion.

4. The multifunctional crib according to claim 2, wherein a top portion of the lifting piece is connected to the pulling rope, and a bottom portion of the lifting piece is provided with a movement opening extending upwardly; the movement opening is internally provided with a movable piece; two sides of the lifting piece are respectively provided with inclined holes communicating with the movement opening, and two sides of the movable piece are respectively provided with clamping posts; each of the clamping posts is corresponding to and located in each of the inclined holes; the clamping rod is connected to a right end of the movable piece; the lifting box is internally provided with a second spring abutting against a top portion of the lifting piece; a left inner surface of the lifting box is provided with a limiting post; a left end of the movable piece is provided with a limiting hole adapted to the limiting post; the limiting post is located in the limiting hole; and the limiting hole is internally provided with a third spring abutting against the limiting post.

5. The multifunctional crib according to claim 1, wherein a left end surface of the left housing is provided with a second slot, and a left end surface of the right housing is provided with a third slot; a right end of the left housing is provided with two symmetrical rocking limiting slots, and the third slot is internally provided with two symmetrical rocking limiting rods; each of the two symmetrical rocking limiting rods is corresponding to each of the two symmetrical rocking limiting slots, and each of left ends of the two symmetrical rocking limiting rods is located in each of the two symmetrical rocking limiting slots; the second slot is internally provided with a second movement slot, and the third slot is internally provided with a third movement slot; the left end surface of the left housing is covered with a first end cover adapted to the second slot; a left end surface of the first end cover is provided with a first sliding slot; the first sliding slot is internally provided with a first sliding button, wherein the first sliding button is slidable left and right; the second movement slot is internally provided with a first movable member, and the third movement slot is internally provided with a second movable member; a plurality of first abutting posts are evenly distributed at a right end surface of the first movable member, and the second movement slot is internally provided with a plurality of post slots, wherein the plurality of first abutting posts extend into the plurality of post slots, respectively; a plurality of second abutting posts are evenly distributed at a left end surface of the second movable member; each of the plurality of second abutting posts is corresponding to each of the plurality of first abutting posts and each of the plurality of post slots, and left ends of the plurality of second abutting posts respectively protrude into the plurality of post slots to abut against the plurality of first abutting posts; the third movement slot is internally provided with a fourth spring abutting against a right end surface of the second movable member; and the first sliding button is connected to the first movable member, and the first sliding button is configured to be fixed to the first end cover after sliding.

6. The multifunctional crib according to claim 5, wherein a right end surface of the first sliding button is provided with a driving portion; the driving portion is provided with a through slot penetrating vertically; an unlocking button passes through the first sliding button; a left end of the unlocking button protrudes out of the first sliding button, and a right end of the unlocking button is located in the through slot and provided with a vertical plate; top and bottom surfaces of the vertical plate are respectively provided with first clamping portions; the through slot is internally provided with a fifth spring abutting against the vertical plate; a right end surface of the driving portion defines a first inclined surface; a left end surface of the first movable member is provided with a fourth movement slot; an end surface of the fourth movement slot defines a second inclined surface attached to the first inclined surface; a right end of the driving portion is located in the fourth movement slot; a front end of the second inclined surface is provided with a limiting portion; a right end surface of the first end cover is provided with two abutting portions arranged vertically; the two abutting portions are corresponding to the first clamping portions on the top and bottom surfaces of the vertical plate, respectively; and each of the first clamping portions abuts against two sides of each of the abutting portions.

7. The multifunctional crib according to claim 5, wherein the second slot is internally provided with two symmetrical first connecting posts, two symmetrical notches and two symmetrical clamping plates; each first connecting post of the two symmetrical first connecting posts is corresponding to each notch of the two symmetrical notches and each clamping plate of the two symmetrical clamping plates, and each clamping plate is located between each first connecting post and each notch; the third slot is internally provided with two symmetrical second connecting posts, and each second connecting post of the two symmetrical second connecting posts is corresponding to each notch; the second slot is internally provided with two symmetrical centering springs; each centering spring of the two symmetrical centering springs is corresponding to each first connecting post, each clamping plate, each notch and each second connecting post; and each centering spring is provided with a first end connected to each first connecting post, a central portion clamped to each clamping plate, and a second end passing through each notch and connected to each second connecting post.

8. The multifunctional crib according to claim 1, wherein the support base comprises a front arc rod, a rear arc rod and a connecting piece; the connecting piece is provided between a top end of the front arc rod and a top end of the rear arc rod; a bottom portion of the support tube is connected to the connecting piece; the front arc rod comprises an upper arc rod and a lower arc rod; a bottom end of the upper arc rod is provided with a lower housing; the lower housing is internally provided with a second sliding slot with a bottom opening; a left end surface of the lower housing is provided with a cover slot; the cover slot is internally provided with a second button; the cover slot is covered with a second end cover adapted to the cover slot; the cover slot is provided with an upper hinge portion and a lower hinge portion; the second button is located between the upper hinge portion and the lower hinge portion; a middle portion of the second button is hinged to the upper hinge portion and the lower hinge portion; a rear portion of a left end surface of the second button is provided with a pressing portion, and the pressing portion passes through a left end surface of the second end cover; a sixth spring is provided between a rear portion of a right end surface of the second button and the cover slot; the lower housing is internally provided with an angle iron piece, and the angle iron piece is in an inverted U shape; left and right sides of the angle iron piece are respectively provided with strip slots; a sliding portion is provided on a top portion of the lower arc rod; the sliding portion is located in the angle iron piece, and the sliding portion is connected to the angle iron piece by a rivet; the rivet passes through the sliding portion and the strip slots on the left and right sides of the angle iron piece; a left end of the rivet is configured to abut against a front end of the second button; and the second sliding slot is internally provided with a seventh spring abutting against the sliding portion.

9. The multifunctional crib according to claim 1, wherein the upper enclosure frame comprises a U-shaped tube, a left connecting tube, a right connecting tube and a detachable tube; two ends of the U-shaped tube respectively pass through the right housing of the left support mechanism and the right housing of the right support mechanism to be respectively connected to the left connecting tube and the right connecting tube; and the detachable tube is detachably provided between the left connecting tube and the right connecting tube.

10. The multifunctional crib according to claim 9, wherein each of two ends of the detachable tube is internally provided with a third movable member and an eighth spring; the third movable member has a bottom portion provided with a push portion, a first end surface provided with an insertion rod, and a second end surface abutting against the eighth spring; an end surface of each of the left connecting tube and the right connecting tube is provided with an insertion slot for an insertion of the insertion rod; an end portion of each of the left connecting tube and the right connecting tube is provided with a positioning portion; and each of two ends of the detachable tube is provided with a positioning slot adapted to the positioning portion.

11. The multifunctional crib according to claim 1, wherein the bottom portion of the connecting rod of the left support mechanism and the bottom portion of the connecting rod of the right support mechanism are respectively provided with a first clamping member and a second clamping member; and the support frame is provided between the first clamping member of the left support mechanism and the second clamping member of the right support mechanism.

* * * * *